US009859652B2

(12) United States Patent
Günther et al.

(10) Patent No.: US 9,859,652 B2
(45) Date of Patent: Jan. 2, 2018

(54) CONNECTOR AND CONNECTOR ASSEMBLY

(71) Applicant: Kathrein Werke KG, Rosenheim (DE)

(72) Inventors: Mario Günther, Rosenheim (DE); Stefan Gruber, Rosenheim (DE)

(73) Assignee: Kathrein Werke KG

( * ) Notice: Subject to any disclaimer, the term of this patent is extended or adjusted under 35 U.S.C. 154(b) by 0 days.

(21) Appl. No.: 15/333,917

(22) Filed: Oct. 25, 2016

(65) Prior Publication Data

US 2017/0162981 A1 Jun. 8, 2017

(30) Foreign Application Priority Data

Dec. 2, 2015 (DE) ..... 10 2015 120 921

(51) Int. Cl.

| | |
|---|---|
| ***H01R 4/50*** | (2006.01) |
| ***H01R 13/631*** | (2006.01) |
| ***H01R 24/38*** | (2011.01) |
| ***H01R 13/213*** | (2006.01) |
| ***H01R 13/625*** | (2006.01) |
| ***H01R 13/639*** | (2006.01) |
| *H01R 103/00* | (2006.01) |

(52) U.S. Cl.

CPC ..... *H01R 13/631* (2013.01); *H01R 13/213* (2013.01); *H01R 13/625* (2013.01); *H01R 13/639* (2013.01); *H01R 24/38* (2013.01); *H01R 2103/00* (2013.01)

(58) Field of Classification Search

CPC .... H01R 13/631; H01R 24/52; H01R 13/005; H01R 4/48; H01R 13/432; H01R 13/04; H01R 13/213; H01R 2103/00; H01R 13/639; H01R 13/625; H01R 24/38

USPC ..... 439/332

See application file for complete search history.

(56) References Cited

U.S. PATENT DOCUMENTS

| | | | | |
|---|---|---|---|---|
| 5,209,678 A * | 5/1993 | Allen | H01R 24/52 | 439/554 |
| 6,206,714 B1 * | 3/2001 | Bernardini | H01R 13/213 | 439/166 |
| 8,337,240 B2 * | 12/2012 | Feldmeier | H01R 13/04 | 439/488 |
| 8,951,057 B2 * | 2/2015 | Linder | H01R 13/187 | 439/314 |
| 9,061,367 B2 * | 6/2015 | Ihde | B23K 9/323 | |

(Continued)

FOREIGN PATENT DOCUMENTS

| | | |
|---|---|---|
| DE | 90 03 016 U1 | 8/1991 |
| DE | 10 2010 045 042 A1 | 11/2011 |

(Continued)

*Primary Examiner* — Jean F Duverne
(74) *Attorney, Agent, or Firm* — Fish IP Law, LLP

(57) ABSTRACT

Provided is a first plug connector which is constructed to be connected at its first end to a first electrical component and at its second end to second plug connector, which is complementary to the first plug connector. The first plug connector enfolds at least one first part of a bayonet-like connection and at least a first locking element for a locking mechanism, which is arranged in such a way, that it extends in the plugging direction. Furthermore, a second plug connector complementary to the first plug connector and able to be connected to it and a comprehensive plug connector arrangement are provided.

17 Claims, 2 Drawing Sheets

(56) References Cited

U.S. PATENT DOCUMENTS

| | | | | |
|---|---|---|---|---|
| 9,397,446 | B2 * | 7/2016 | Takagi | H01R 13/432 |
| 9,409,536 | B2 * | 8/2016 | Gunreben | B60R 21/16 |
| 9,450,323 | B2 * | 9/2016 | Ohkubo | H01R 4/48 |
| 9,543,677 | B1 * | 1/2017 | Ferrier | H01R 13/005 |

FOREIGN PATENT DOCUMENTS

| | | | |
|---|---|---|---|
| FR | 1188157 | A | 9/1959 |
| JP | 2015-111962 | A | 6/2015 |

* cited by examiner

CONNECTOR AND CONNECTOR ASSEMBLY

This application claims the benefit of priority to Germany Patent Application No. 10 2015 120 921.7, filed Dec. 2, 2015.

FIELD OF THE INVENTION

This invention relates to two matching, complementary (plug) connectors and a (plug) connector assembly.

BACKGROUND OF THE INVENTION

Electrical plug connections are required for a variety of applications, e.g. for connecting coaxial cables for radio frequency applications or for the connection of other components with each other and with the cabling, e.g. in automotive applications. The difficulty with these connections is that the plug connection must be prevented from separating. For this reason, numerous fixing devices are known which prevent the separation of the two sides of a plug connector. A fixed connection can be made by means of a very wide range of fixing devices, e.g. by means of several auxiliary elements, which provide the connection by means of a rotary movement. This connection method is preferred for approximately cylindrical plug connectors. Alternatively, the connection between, e.g. rectangular plug connectors, is achieved by slide elements, which lock together by means of spring elements.

Various fixing devices for plug connectors are suggested in US 2015/0177467 A1. Here, a number of additional components, such as pins, snap joints, spring elements etc., are recommended to protect the plug against twisting out.

US 2006/0172580A1 proposes the fixation of the plug connector by means of several elements that have to be joined together. The connection is mainly made by the initial twisting of one of the elements and the fixation is provided by spring arms, which lock on or snap into corresponding counter elements.

DE 91 05 436 U1 discloses a plug connector arrangement with an operator element in the form of a rotating ring for the fixation of the two plug connectors. When the two plug connectors are connected, the rotating ring is twisted, by means of a bayonet-like connection, over both plug connectors so that it encloses part of each of the plugs. The final fixation of the two plug connectors is provided by the locking protrusions on the external circumference of one of the plug connectors and the locking recesses arranged on the inside of the rotating ring, which lock together when the rotating ring is twisted on and reaches its end position.

The previously suggested plug connector arrangements are of only limited use for radio frequency applications, because they either comprise of a large number of parts or require too much space. With solutions involving several parts, this causes the problem that the solution becomes costly on account of the number of parts. In addition, there is the risk that intermodulations can occur if the parts are not accurately matched to each other or if non-intermodulation-free material has been used in order to prevent wear. In addition, assembly of the parts is complicated and therefore costly. In the case of solutions which only require a small number of parts the problem exists that, for example, on account of a rotating ring required for the connection a certain amount of space is needed, so that several plug connectors cannot be arranged closely spaced, which, in turn, further increases the costs.

For this reason, the purpose of this invention is to provide matching plug connectors and a plug connector arrangement, with which the problems described above are solved. In particular, miniaturization of the plug connectors or the total system of the plug connector arrangement shall be realized. This task is solved by the features in the invention described in the independent patent claims. Advantageous embodiments are the subjects of the dependent claims.

SUMMARY OF THE INVENTION

According to the invention, a first plug connector is proposed which is constructed so that it can be connected at its first end to a first electrical component and at its second end to a second plug connector, which is complementary to the first plug connector, with the first plug connector containing at least the first part of a bayonet-like connection and at least a first locking element with a locking mechanism, which is arranged in the plugging direction.

By means of the provision of the combination of a bayonet-like connection and a locking element, which is arranged in the plugging direction, no additional elements such as sliders or adapters are required for the fixation of the plug connector. Furthermore, by arranging the locking element in the plugging direction, it is possible, to connect a complementary second plug connector to the first plug connector in such a way that the space required for both plug connectors is able to be minimized, thus allowing several plug connector arrangements to be located very close to each other.

A bayonet-like connection refers to a connection in which one of the two plug connectors shows at least one insertion ramp at an angle to the plugging direction with a first guide element and the other of the two plug connectors includes a second guide element which fits over the first guide element and into the insertion ramp. By inserting the second guide element into the insertion ramp and over the first guide element, and twisting the second guide element along the insertion ramp, depending on the movement direction, the two plug connectors are moved towards each other or apart from each other. In contrast to bayonet connections, bayonet-like connections do not require or deploy overlifting. Overlifting refers to the snapping of a guide element into a recess in the insertion ramp, which means that simply moving the guide element from the end zone of the insertion ramp is not possible without applying a force. The disadvantage of overlifting is that, for the separation of the connection, an axial movement of the plug connectors on face of each other is required, so that a disadvantageous, repeated rubbing over of the electrical contacts occurs.

In a further embodiment, it is provided that the first part of the bayonet-like connection is constructed in the form of an insertion aid located between the first end and the second end, arranged at an angle to the plugging direction of the plug connection, and the first locking element is located at the face of the second end of the first plug connector or at a distance from the face of the second end of the first plug connector.

In a further embodiment, it is provided that the first part of the bayonet-like connection is located at the second end of the first plug connector as a second guide element and that the first locking element forming the first part of the bayonet-like connection is arranged at a distance and in parallel to the first end of the first plug connector.

The arrangement of the first locking element on the plug connector determines, which second plug connector can be connected to the first plug connector. By means of the correspondingly arranged first locking element, a miniaturization is achieved of both the plug connectors and the plug connector arrangement comprising two connected, complementary plug connectors.

By means of the corresponding arrangement of the first part and the locking element with regard to each other and with regard to the second end of the plug connector, it is ensured that no overlifting occurs during the plugging or unplugging of the two plug connectors.

In a further embodiment, it is provided that the first locking element is a locking recess or a locking protrusion.

In a further embodiment, it is provided that the first plug connector at least comprises two first parts of a bayonet-like connection. In a further embodiment, it is provided that the first plug connector at least comprises two first locking elements. In a further embodiment, it is provided that at least the two first locking elements are arranged symmetrically.

By means of the provision of several first parts of the bayonet-like connection and/or several locking elements, in the form of locking recesses, locking protrusions or a combination of these, a further improved fixation of the plug connectors is made possible.

Furthermore, within the context of this invention, a further plug connector is provided, which is complementary to the first plug connector according to one of the above claims, and therefore can be inserted in the plug connection and which is constructed in such a way that it can be connected by a first end zone to a second electrical component and at its second end zone to the first plug connector. The second plug connector enfolds at least one second part of a bayonet-like connection which is the complementary part to the first plug connector and at least a second locking element for a locking mechanism, which is arranged in such a way, that it extends in the plugging direction, with the at least one second locking element having a shape complementary to the shape of the first locking element.

The second plug connector is constructed complementary to the first plug connector and therefore boasts the same advantages, in particular, that miniaturization of the entire system consisting of the first and the second plug connectors can be achieved.

In the context of this invention, it is also provided that the first and/or the second plug connector(s) is/are constructed from one, two or several part(s).

A single-part construction of the plug connector is very cost-efficient, while a two-part construction of the plug connector has the advantage that the installation to the relevant component, e.g. a cable can be simplified. If necessary, it is also possible to construct the plug connector from several parts. Which plug connector is chosen depends on the application.

Within the context of this invention, furthermore, a plug connector arrangement is provided, comprising a first plug connector and a second plug connector, as described above. To do this, the first part of the bayonet-like connection and the second part of the bayonet-like connection are constructed and arranged complementary to each other in such a way that the first plug connector can be combined with or separated from the second plug connector. The first locking element and the second locking element are constructed and arranged complementary to each other in such a way that the first locking element interlocks with the second locking element in such an arrangement that the two plug connectors are located at one of the end positions of the bayonet-like connection.

On account of the plug connector arrangement comprising the first and the second plug connector, a miniaturization of the plug connector arrangement is achieved, so that several plug connector arrangements can be located close to each other and are able to be easily assembled. The plug connector arrangement combines all the advantages of the individual plug connectors.

In a further embodiment, it is provided that, if the first part of the bayonet-like connection is constructed as a guide protrusion, and the first locking element is constructed as a locking protrusion, the guide protrusion and/or of the locking protrusion and/or of the material of the plug connector are elastically deformed during the combination or separation of the plug connectors in or against the plugging direction, with the deformation being reversible.

On account of the elastic deformation, overlifting can be avoided during the combination or separation processes. Furthermore, the reversibility offers an additional protection against sliding out of the bayonet-like connection.

Further features and advantages of the invention result from the following description of implementations of the invention with figures and drawings showing details covered by the invention and its claims. Any variant of the invention is realized by implementing individual features, individually or in any combination.

BRIEF DESCRIPTION OF THE DRAWINGS

Preferred implementations of the invention will be described in more detail with reference to the enclosed drawings.

DETAILED DESCRIPTION

In the following descriptions of the figures, the same elements or functions are marked with the same identifiers.

Figure 1:
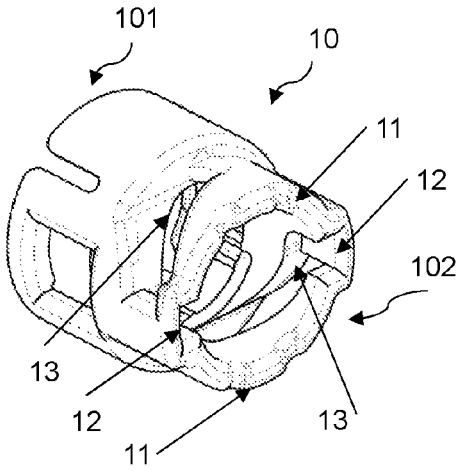
FIG. 1 shows a view of a plug connector in accordance with an embodiment of this invention.
Figure 2:
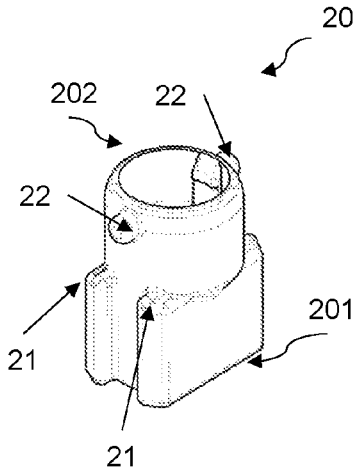
FIG. 2 shows a view of a plug connector complementary to the one shown in FIG. 1 in accordance with an embodiment of this invention.
Figure 3:
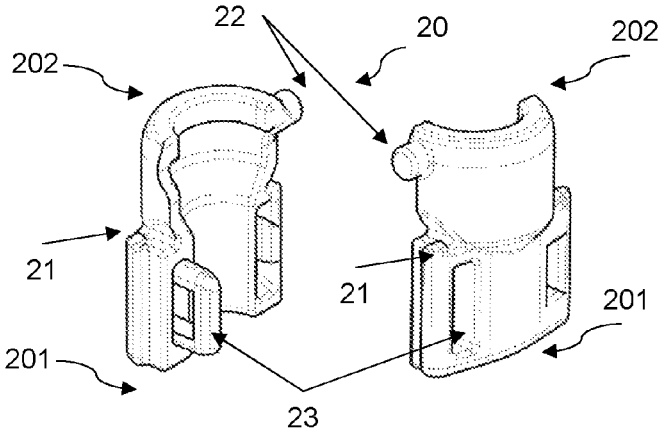
FIG. 3 shows a view of a two-part plug connector as shown in FIG. 3 in accordance with an embodiment of this invention.

FIGS. 1 and 2 show views of two complementary first and second plug connectors 10 and 20 in accordance with an embodiment of this invention. FIG. 3 shows the plug connector 20 shown in FIG. 2 as a two-part plug connector.

The plug connector shown in FIG. 3 differs from the plug connector shown in FIG. 2 only by the fact, that for easier mounting onto e.g. a cable, it is constructed from two parts and it can be combined to form a complete plug connector by means of the connection elements 23. The connection elements 23 can be constructed in different ways, as a snap joint, as a screw joint, they can be glued, welded or connected in a different way provided the plug connector is firmly attached to the component.

In the description below, the plug connector shown in FIG. 1 is described as the first plug connector 10 and the plug connector shown in FIG. 2 or FIG. 3 is described as the second plug connector 20, where the designations only serve to make the description easier. The reversed designations could be used equally well. The same applies for all of the components below described as "first".

In FIG. 1 a first plug connector 10 is shown, which at its end zone 101 can be connected to an electrical component, e.g. a cable, a socket or a different component. At its second end 102, the first plug connector 10 can be connected to a second end zone 202 of a second plug connector 20 shown in FIG. 2, which has a shape complementary to that of the first plug connector 10.

For this, the body of the first plug connector 10 is equipped with the insertion aids 12 and 13 for the combination of the two plug connectors 10 and 20. The insertion aids 12 and 13, shown in FIG. 1, include the insertion ramps 13 on the body of the first plug connector 10 opposite to each other, which allow the bayonet-like locking, as well as a first guide element 12, which is located on the face of the first plug connector 10 in the form of a recess within the circumference, in order to accommodate the guide protrusion 22 of a second plug connector 20 and guide it into the insertion ramp 13. 13. The insertion aids 12 and 13 serve as the first part of a bayonet-like connection in conjunction with the second complementary part of the bayonet-like connection, which are shown in FIG. 2 correspondingly in the form of guide protrusions 22.

The second plug connector 20, shown in FIG. 2 or 3, can at its first end zone 201, be connected to an electrical component, e.g. a cable. At its second end zone 202, its shape allows connection to the first plug connector 10. To do this, it is shaped as a complementary plug connector to the first plug connector 10 in such a way that it contains a second guide element 22 as the second part of the bayonet-like connection in the shape of a guide protrusion 22. In FIG. 2 or FIG. 3, two guide protrusions 22 are provided, which fit into the corresponding first guide element 12 on the first plug connector 10.

In the embodiment shown in FIGS. 1 and 2 or 3, the first and the second plug connectors 10 and 20 are essentially cylindrical. However, any other suitable shape can be chosen, as long as the connection can be made as described in this invention.

In FIG. 1, two insertion ramps 13 and two first guide elements 12 are shown. Depending on the application, it is, however, possible to provide only one insertion ramp 13 and one first guide element 12 or more than two insertion ramps 13 or first guide elements 12. The second plug connector 20 for the connection to the first plug connector 10 is chosen correspondingly.

The first guide elements 12, shown in FIG. 1, are shaped in such a way that they form recesses in the circumference at the face of the first plug connector 10, so that a second complementary guide element 22, e.g. a guide protrusion, can be guided by it in order to then be inserted into the insertion ramp 13. The first guide element 12 in the form of a recess, has the advantage that even in its end position it will not, or only negligibly, protrude further from the plug connector arrangement than the second guide element 22 inserted via the bayonet-like connection of the second plug connector 20.

In addition to the space-saving bayonet-like connection, the first plug connector 10, shown in FIG. 1, provides at its face four first locking elements 11 for the secure fixation of the connection, which are arranged in pairs side-by-side and opposite to the other two locking elements 11. The first locking elements 11 are arranged at the face or close to it, i.e. at a small distance from the face of the second end 102 of the first plug connector 10, in order to lock in the plugging direction to the corresponding complementary second locking elements 21 of the second plug connector 20. The arrangement of the locking elements 11 depends on the application and is not limited to the locking elements 11 being located directly at the face of the second end 102 on the first plug connector 10. Rather, a distance to the face can be specified, as long as the complementary locking element 21 has an appropriate shape to achieve the same locking effect.

The second plug connector 20, shown in FIG. 2 or FIG. 3, has at a distance from its second end zone 202, at which the guide protrusions 22 are located, the second locking elements 21 complementary to the locking recesses 11, shown in FIG. 1, which have the shape of locking protrusions 21. The second locking elements 21 are arranged in such a way on the second plug connector in FIG. 2 that, in the plugging direction, i.e. the direction, in which the first plug connector is combined with or disconnected from the second plug connector (see reference mark 40 in FIG. 4), it can lock to the first locking element on the first plug connector 10.

The shape of the locking elements 11 and 21 is chosen so that a firm, largely play-free connection is achieved after locking together. Shapes like triangles, trapezes, nubs or others can be chosen to enable the locking together. Advantageous is a choice of shape which can be easily manufactured, e.g. by injection molding.

Figure 7:
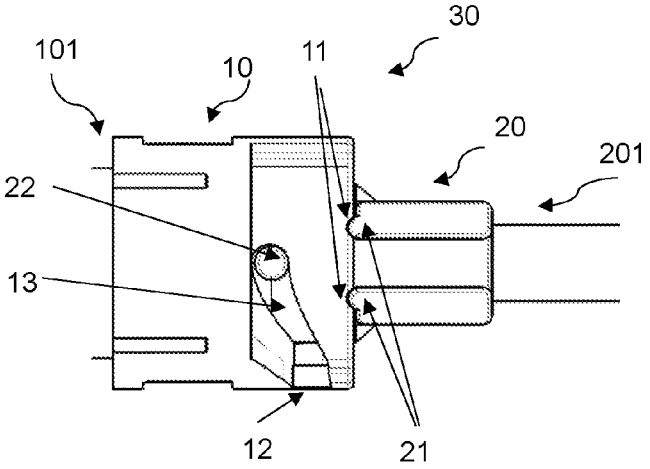
FIG. 7 shows a view of a plug connector arrangement in its end position in accordance with an embodiment of this invention.
Figure 4:
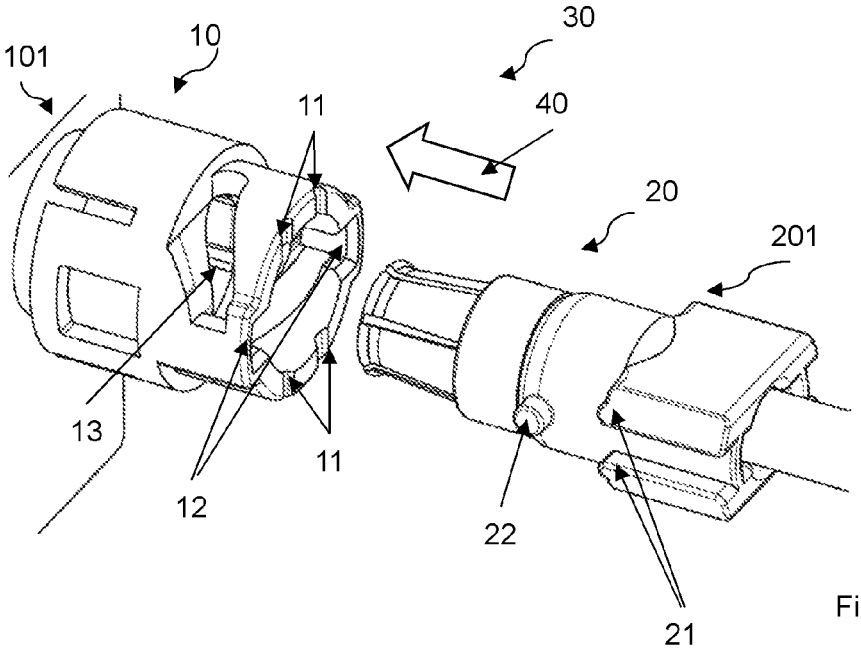
FIG. 4 shows a view of the combination of the first and the second plug connectors in accordance with an embodiment of this invention.
Figure 5:
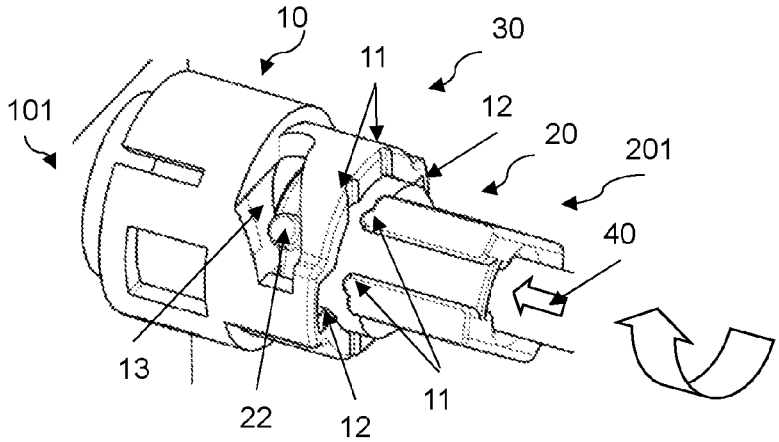
FIG. 5 shows a view of the combination and twisting of the first and the second plug connectors, in accordance with an embodiment of this invention.
Figure 6:
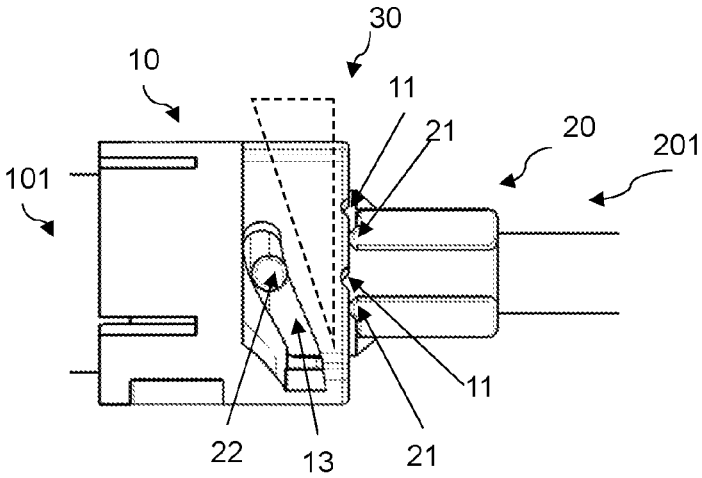
FIG. 6 shows a view of the combination and twisting to just before the end position of the first and the second plug connectors, in accordance with an embodiment of this invention.

The plug connector material is chosen so that, in radio frequency applications, intermodulation is prevented or that it is resistant to intermodulation. Furthermore, the material should provide a certain elasticity because, in order to avoid overlifting with the bayonet-like connection, an elastic deformation and return to the original form is required for at least the guide element 22 in the form of a guide protrusion. Equally, a locking element can be constructed elastically. This is the obvious solution if the guide protrusion 22 and the locking protrusion 21 are located at the same plug connector. In this case, it is also advantageous if the guide protrusion 22 is closer to the second end zone 202 of the plug connector than the locking protrusion 21, which, in turn, is arranged at a distance from the guide protrusion 22. When combining the two plug connectors, as shown in FIG. 4, the guide protrusions 22 of the second plug connector 20 are inserted into the guide recesses 12 in the first plug connector 10. Then the plug connectors 10 and 20 are twisted with respect to each other as shown in FIG. 5, so that the guide protrusions 22 are inserted into the insertion ramps 13 until the locking elements 21 of the second plug connector 20 meet the face of the first plug connector 10. This is shown in FIG. 6. In FIG. 6, it is shown that the guide protrusions 22 have not yet reached an end position and the locking elements 11, 21 have not yet locked together. In order to reach the end position or to achieve the locking, the two plug connectors are rotated further. When doing this, the distance between the guide protrusions 22 and the locking protrusions 21 is elastically expanded on account of the material between the insertion ramp 13 and the face of the first plug connector 10, which in the rotation direction corresponds to a wedge. When the end position is reached, as shown in FIG. 7, the material of the second plug connector 20 can elastically return to its original shape while the locking elements 21 lock to each other. Depending on the application and the manufacturing tolerances, a residual stress can remain in the guide protrusions 22 in the axial direction, i.e. in the plugging direction 40. On account of the elastic deformability of the guide protrusions 22 and/or the locking elements 21, overlifting can be avoided inside the plug connectors 10, 20, i.e. when the components are electrically connected to each other, which results in a higher reliability.

In FIG. 7, a plug connector arrangement 30 is shown, in which the first plug connector 10 has been connected to the second plug connector 20 and where the end position has been reached, i.e. the locking elements 11 and 21 are locked to each other. On account of the space-saving bayonet-like connection and the locking elements arranged in the plugging direction, the plug connector arrangement 30 requires very little space and can be easily mounted. For this reason, several plug connector arrangements can be located side by side closely spaced, which in turn results in a cost saving.

The plug connector arrangement is separated by reversing the mounting process. The lock connection can be separated by applying a force, which is determined by the corresponding choice of the locking elements 11 or 21. On account of the elastic deformability of the guide element 22 or the locking elements 21 and/or of the material of the plug connector, no overlifting occurs at the electrical components during the separation process of the plug connector arrangement.

In the figures, concretely a "first" and a "second" plug connector, guide element and locking element are referred to. This concretization is only used to achieve a better description. The designations "first" and "second" are therefore interchangeable.

On account of the axial combination of the plug connectors, a minimized space requirement has been realized without detrimental effect on the secure fixation of the plug connectors.

LIST OF IDENTIFIERS

10 First plug connector
101 First end
102 Second end
11 First locking element
12 First guide element
13 Insertion ramp
20 Second plug connector
201 First end zone
202 Second end zone
21 Second locking element
22 Second part of the bayonet-like connection or second guide element
23 Connection elements
30 Plug connector arrangement
40 Plugging direction

What is claimed is:

1. A first plug connector (10) which is constructed to be connected at its first end (101) to a first electrical component and at its second end (102) to a second plug connector (20), which is complementary to the first plug connector (10), wherein the first plug connector (10) comprises:

at least one first component (12, 13) of a bayonet-like connection, wherein the first component (12, 13) of the bayonet-like connection is constructed as an insertion aid (13) at an angle to the plugging direction (40) of the first plug connector (10) between its first end (101) and its second end (102), and as a first guide element (12), which is located at the face of the second end (102) of the first plug connector in such a way that it extends in a plugging direction (40), characterized by at least one first locking element (11) of a locking mechanism, which is arranged at the face of the second end (102) of the first plug connector (10) and which is arranged in such away that it extends in a plugging direction (40) such that it interlocks with the face when the first plug connector (10) is connected to the corresponding second locking element (21) of the second plug connector (20), wherein the first guide element (12) and the first locking element (11) are arranged at different positions of the face.

2. The first plug connector (10) according to claim 1, wherein the first locking element (11) is a locking recess or a locking protrusion.

3. The first plug connector (10) according to claim 1, further comprising at least two first locking elements (11).

4. The first plug connector (10) according to claim 3, where the at least two first locking elements (11) are arranged symmetrically with respect to each other.

5. The first plug connector (10) according to claim 1, wherein the first plug connector (10) is made from a single component, two components, or several components.

6. A second plug connector (20), which is constructed to be connected at its first end (201) to a first electrical component and at its second end (202) to the first plug connector (10) according to claim 1, and which is complementary to the first plug connector (10), wherein the second plug connector at least one second component (22) of a bayonet-like connection which is constructed and arranged such that it engages with the insertion aid (13) of the first plug connector (10) after connection, characterized by at least a second locking element (21), which is arranged at a distance to the face of the second end (202) of the second plug connector (20) in direction to the first end (201), which is arranged such, that it interlocks with the corresponding first locking element (11) of the first plug connector (10) after connection of the second plug connector (20 with the first plug connector (10).

7. The second plug connector (20) according to claim 6, wherein the second plug connector (20) is made from a single component, two components, or several components.

8. A plug connector arrangement (30), comprising:

the second plug connector according to claim 6 being constructed complementary to the first plug connector (10), wherein the first component (12, 13) of the bayonet-like connection and the second component (22) of the bayonet-like connection are constructed and arranged complementary in such a way that the first plug connector (10) can be combined with and separated from the second plug connector (20), and wherein the first locking element (11) and the second locking element (11) are constructed and arranged complementary to each other in such a way that the first locking element (11) interlocks with the second locking element (21) in such an way that the two plug connectors (10, 20) are located at one of the end positions of the bayonet-like connection (12, 13; 22).

9. The plug connector arrangement (30) according to claim 8, wherein, the second guiding element (22) of the bayonet-like connection is constructed as a guide protrusion, and the second locking element (21) is constructed as a locking protrusion, and wherein the guide protrusion and/or the locking protrusion and/or lithe material of the plug connector (20) are elastically deformed during the combination or separation of the plug connectors (10, 20) in or against the plugging direction (40), with the deformation being reversible.

10. The second plug connector (20) according to claim 6, wherein the first locking element (11) of the first plug connector (10) is a locking recess or a locking protrusion.

11. The second plug connector (20) according to claim 6, the first plug connector (10) further comprising at least two first locking elements (11).

12. The second plug connector (20) according to claim 11, where the at least two first locking elements (11) are arranged symmetrically with respect to each other.

13. The plug connector arrangement (30) according to claim 8, wherein the first locking element (11) of the first plug connector (10) or of the second plug connector (20) is a locking recess or a locking protrusion.

14. The plug connector arrangement (30) according to claim 8, wherein the first plug connector (10) further comprises at least two first locking elements (11).

15. The plug connector arrangement (30) according to claim 14, where the at least two first locking elements (11) are arranged symmetrically with respect to each other.

16. The plug connector arrangement (30) according to claim 8, wherein the first plug connector (10) is made from a single component, two components, or several components.

17. The second plug connector (20) according to claim 6, wherein the second plug connector (20) is made from a single component, two components, or several components.

* * * * *